United States Patent [19]

Koerner et al.

[11] Patent Number: 4,576,148

[45] Date of Patent: Mar. 18, 1986

[54] CONTINUOUS PASSIVE MOTION HAND DEVICE

[75] Inventors: Richard J. Koerner, Encinitas; Christopher C. Dumas, San Diego; Philip J. Filia, San Diego; Ronald L. Lawrence, San Diego; David B. Petch, San Diego, all of Calif.

[73] Assignee: Sutter Biomedical, Inc., San Diego, Calif.

[21] Appl. No.: 576,592

[22] Filed: Feb. 3, 1984

[51] Int. Cl.[4] ..... A61H 1/02

[52] U.S. Cl. ..... 128/26; 128/25 R

[58] Field of Search ..... 128/26, 25 R, 24 R, 128/25 B; 272/67, 93, 129; 3/12.6, 12.7; 623/63, 64

[56] References Cited

U.S. PATENT DOCUMENTS

| | | | |
|---|---|---|---|
| 2,216,764 | 10/1940 | Clark | 128/25 B |
| 2,228,934 | 1/1941 | Tjomsland | 128/26 X |
| 2,353,129 | 7/1944 | DeMona | 128/26 |
| 2,832,334 | 4/1958 | Whitelaw | 128/25 R |
| 3,323,518 | 6/1967 | Swanson | 128/25 R |
| 3,929,335 | 12/1975 | Malick | 128/25 R X |
| 4,039,183 | 8/1977 | Sakurada | 128/67 |
| 4,310,154 | 1/1982 | Kauffman | 272/67 |

*Primary Examiner*—Richard J. Apley
*Assistant Examiner*—Kathleen D'Arrigo
*Attorney, Agent, or Firm*—Flehr, Hohbach, Test, Albritton & Herbert

[57] ABSTRACT

A continuous passive motion therapy device with drive means carried on the patients hand or arm having a gear train extending down the patients hand and movable drive arms connectable at a plurality of locations along the gear train to selectively exercise the metacarpophalangeal joint or the interphalangeal joint.

23 Claims, 8 Drawing Figures

CONTINUOUS PASSIVE MOTION HAND DEVICE

The present invention relates generally to orthopedic equipment and more particularly to a continuous passive motion device for the joints in the hand.

When a patient undergoes repair of a flexor tendon in the hand, or replacement of the finger joint, an important part of the healing process is the application of both active motion, that is voluntary motion, and especially passive or involuntary motion. It has been found that early intermittent passive mobilization of the repaired flexor tendons in the hand, or the replaced finger joint, improves tendon healing, prevents tendon scarring, and improves the active (voluntary) range of motion. Passive flexion exercises also have been recommended in rehabilitation programs of patients undergoing flexible implant arthroplasty of the fingers.

Accordingly, it is an object of the present invention to provide a device for the application of continuous passive motion for predetermined periods of time to the fingers.

Each finger except the thumb can be essentially divided into three sections: the proximal phalanx which is the portion of the finger closest to the large knuckle; the intermediate phalanx and the distal phalanx or the end portion of the finger extending from the last joint to the tip of the finger. The proximal phalanx is joined to the metacarpal bone in the hand at the metacarpophalangeal joint, and to the intermediate phalanx at the proximal interphalangeal joint. The intermediate phalanx is joined to the distal phalanx at the distal interphalangeal joint. Depending on the injury for which recovery is needed, it is important to provide either isolated metacarpophalangeal (MP) joint motion, or interphalangeal (IP) joint motion of the two interphalangeal joints.

It is therefore and objective of the present invention to provide a drive unit having an adjustable drive mechanism which can be attached to the fingers of the injured hand to provide either MP or IP joint motion.

Passive motion treatment of hand injuries can be frustrating for a patient, as the patient is not normally immobilized, as usually occurs with lower limb injuries. It is therefore an objective of the present invention to provide a fully portable continuous passive motion (CPM) device for the hand.

It is a further objective of the present invention to provide a CPM device for the hand which can be easily carried on the wearer's hand without unduly restricting the wearer's ability to otherwise normally function using his other hand. A further objective of the present invention to provide a Continuous Passive Motion Device which can be easily carried on the back of the wearer's hand or arm.

Another objective of the present invention is to provide a continuous passive motion device which occupies relatively little room and includes a minimum number of moving parts, but which can be readily adjusted to fit the hand of any wearer.

Yet another objective of the present invention is to provide a simple and reliable means for attaching any one or more fingers of the injured hand to the drive bar of the device using a simple but reliable connecting device. Such a connecting device should be easy to install.

As an objective of the present invention is to provide a highly portable device which will allow the wearer to move freely about, the wearer will not typically be in a hospital or other controlled setting. The parameters of the treatment, including the range of motion and the time of treatment, will typically be defined by a therapist or the like and set into the microprocessor-controlled system store. It is important that the patient not be able to modify or interfere with these parameters.

Therefore, an objective of the present invention is to include a program interlock defined to prevent access of the patient to the set parameters of the treatment mode except to stop the use of the system completely. It is a further objective of the present invention to provide a mechanical interlock which is easy to use for the therapist or the person who is defining the parameters of the treatment mode.

These and other objectives of the present invention are achieved in a continuous passive motion device for the hand which selectively provides continuous passive motion to the metacarpophalangeal (MP) and or interphalangeal (IP) joints of selected fingers (excluding the thumb) of the joints of the hand. The device consists essentially of two components: a hand drive unit that mounts to a forearm splint, and a microprocessor based controller drawing power from a rechargeable power pack. The hand drive unit includes a housing having a base portion mounted on the forearm splint for supporting the motor and other control components, and a gear drive train for conveying rotational movement of the joints of the fingers.

In a preferred embodiment, the housing includes two arms which extend from the base portion down the sides of the patients hand; a gear train is included in each arm. Movable drive arms are connected to either of two points on the drive train; the point of connection, which is coaxial with one of two separate gears in each train, causes rotation of the drive arms about an axis which defines metacarpophalangeal (MP) joint motion or interphalangeal (IP) joint motion in the joints of the attached fingers.

The ends of the drive arms are connected to a finger drive rod. The drive rod is selectively connected to the fingers of the hand utilizing drive blocks which comprise a rectangular slotted plastic block mounted on a adhesive tape. The drive rod passes through the slot on the block to convey the rotational motion of the drive arms to the finger joints, the adhesive band is wrapped around the appropriate portion of the finger which is to undergo continuous passive motion treatment. For interphalangeal (IP) joint motion, the block is adhesively attached to the distal phalanx; for metacarpophalangeal (MP) joint motion, the block is attached to the proximal phalanx.

Preferably, the arms of the housing and the gear train included therein are designed so that the axis of motion of the drive arms lies in close as possible to the axis of the joint to be exercised when the CPM device is in place on the hand.

The finger attachment devices are designed to allow efficient transmission of the rotational force provided by the moving finger drive rod to the joints of the fingers, while preventing rotation of the fingers about the longitudinal axis of the finger.

A stopper motor whose rotation is divided into approximately six degree steps is provided with microprocessor control. In accordance with the parameters defined by the microprocessor, the gear control the motion of the drive arms and thereby the finger drive rod move the drive arms through a defined range of motion. The parameters include upper limit extension (to a maximum of 0°); full flexion (to a maximum of about 135°); time to run; elapsed time; rate of speed; and amount of force at the finger drive rod.

Other features of the present invention include a simple means for locking the hand drive unit in place on the hand or forearm of the wearer and for releasing the unit from the hand.

In a further desirable feature of the present invention, means are provided for defining a zero position signal which may be conveyed to the microprocessor, so that the microprocessor always knows at the start of any treatment cycle the exact position of the drive arms.

The novel features which are considered characteristic of the invention are set forth in particular in the appended claims. The continuous passive motion hand device itself both as to its construction and its mode of operation together with other features and advantages thereof will be best understood by a reading of the following detailed description of a specific embodiment with reference to the accompanying drawings wherein:

FIG. 4 is a side view of a means for unlocking the lock shown in FIG. 4;

Figure 1A:
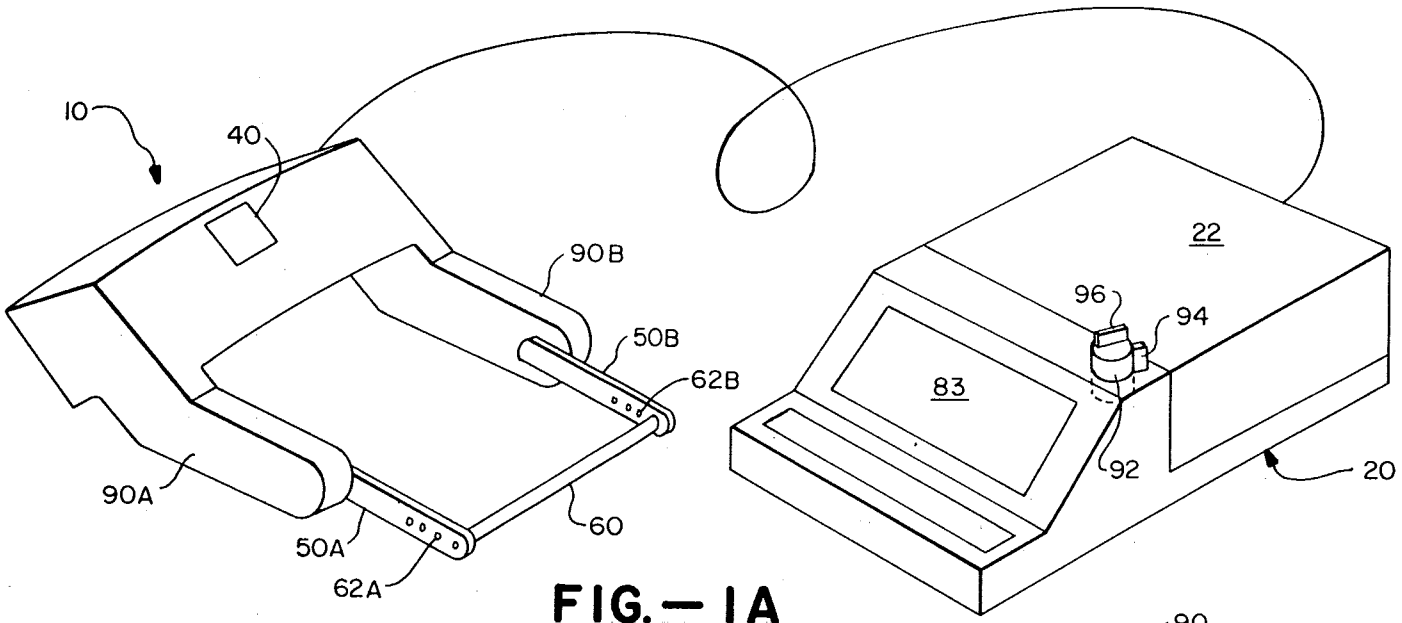
FIGS. 1A and 1B show in outline form the basic elements of the present invention.

This invention is an electromechanical device for imparting continuous passive motion selectively to the MP and IP joints of the hand. The device consists of two components: The hand drive unit 10 that mounts to a forearm splint 12 (shown in FIG. 2), and a microprocessor based controller 20 which is powered by a rechargeable battery power pack 22. Portability is achieved through this design, which mounts the continuous passive motion device 10 on the back of the user's hand as shown in FIG. 2 while providing a battery powered controller for the motor to be provided which can be hung from shoulder of the user with a shoulder strap.

The hand drive unit 10 is designed to move the metacarpophalangeal joint i.e. the one closest to the large knuckle, or the interphalangeal joints through a range of motion from zero degrees extension to ninety degrees flexion. This is accomplished by mounting the hand drive unit 10 on the back of a splint 12, which is a simple plastic splint which covers the back of the forearm and hand of the user. The splint is attached to the user's hand with velcro straps 26, 28. The CPM device is locked in place by means of a sliding L-shaped tongue 30 which appears in a vertical section in FIG. 3, and in cross section in FIGS. 4 and 5. The sliding L-shaped tongue is shown in FIG. 4 in place beneath the bracket 32 and on top of the splint 34. The bracket 32 is fastened to the top of splint 34 using two screws 36, one on each side of the bracket. The screws are screwed into the underside of the splint 12, and when screwed down tightly work themselves into the surface of the underside of the splint to be essentially flush with the surface of the splint. Thus the back of the forearm of the user is not irritated by the presence of the bracket.

The CPM device is placed onto the splint by sliding it away from the fingers of the hand on which it is to be mounted. The bottom portion 30 of the L-shaped tongue 32 is mounted on the front of the housing and extends below the housing, so that the tongue slides under the bracket. A polygon shaped catch 36 extends out of the bottom of the housing. This element includes an upwardly inclined surface 38 which slides over the surface of the bracket until it drops into the slot 39. The device can be unlocked to take the CPM device off the hand, by depressing the button 40 located on the front of the housing (see the detail of FIG. 5; the handle is also indicated generally in FIG. 1). The locking catch 36 is fastened to the base of the housing by a rivet 42 at the distal end of the base. As a result, when the button is flexed upward, the top portion 42 of the L-shaped tongue 32 moves upward, lifting the front edge of the locking element 36 and allowing the CPM device to slide out the slot 39.

Figure 1B:
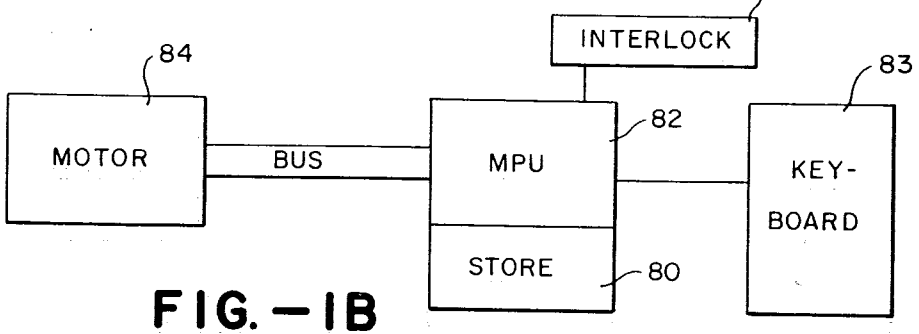
Figure 2:
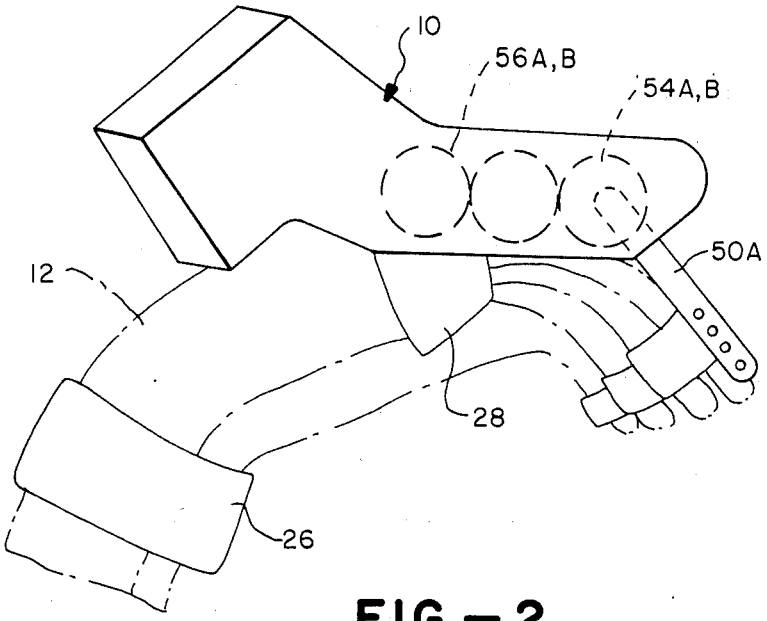
FIG. 2 shows a side view of the CPM device mounted on the forearm of a wearer.

Once the CPM device 10 is in place on the user's hand, it is attached to the fingers of the hand in a manner which can be see by reference to FIGS. 1A and 2. Specifically, each of the drive arms 50A, 50B, are attached to one of two possible sets of coaxial drive gears 54A, 54B or 56A, 56B. Depending on the gear wheel set to which the drive arms 50 are attached, these arms are now centered on the proper axis for either isolated MP joint motion or IP joint motion. In the exemplary embodiment in FIG. 2, it can be seen that the drive arm 50 is attached to the distal gear of the rotating gear drive (which is shown completely in FIG. 6).

Figure 7:
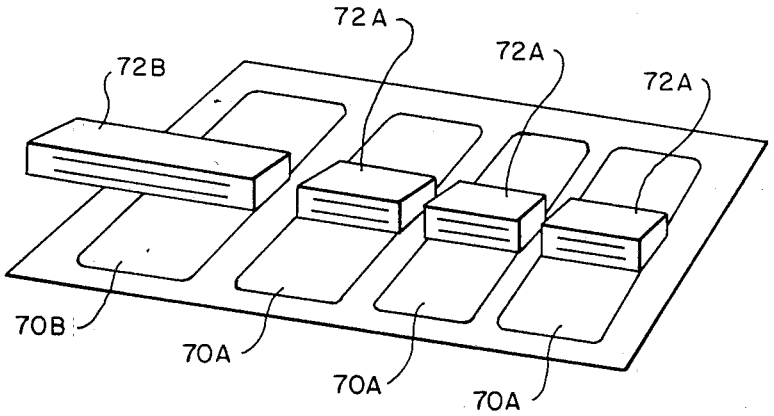
FIG. 7 is a view of a set of the blocks with attached adhesive tape used to attach the drive rod to selected fingers of the user to provide continuous passive motion (CPM) to selected joints on the hand of the user.

This gear, when the unit 10 is in place on the user's hand, will sit near the proximal interphalangeal joint between the proximal phalanx and intermediate phalanx portions of the fingers. The drive means 50 extend out parallel to the fingers to be treated, and are connected by a drive rod 60. The rod 60 may be run between any of the pairs of holes 62A, 62B, located on each drive arm, depending on the length of the patients fingers. The patients fingers are now connected to the drive rod. Each finger that is to be subjected to the CPM treatment is connected to the drive rod through one of the drive blocks 70 shown in FIG. 7. The blocks are shown with their adhesive backing resting on the sterile backing in the form in which they would be delivered to a therapist for use on the patient. Three blocks with adhesive backing strips labeled 72A are for use for the three center digits on a hand; a fourth block of approximately twice the length of the other three blocks is for use on the shortest digit of a persons hand. Each block contains a longitudinal slot in which the drive rod 60 can move to rotate the joints of the fingers without allowing the fingers to rotate about their own longitudinal axis more than about 10 degrees. This is important because some persons suffering from arthritis or the like are susceptible to such longitudinal axis rotation.

Each drive block is put on the drive rod, and the adhesive backing tape which is a band aid type strip preferaly Med 5720P produced by Avery International is wrapped around the distal phalanx of the patients finger (assuming IP joint motion is desired). The blocks 72 are fastened to the back non-sticking side of the adhesive tape using a double coated tape such as MED-3044 made by Avery International, although ultrasonic welding or an adhesive of some sort may also be suitably used. In either event, it has been found that these drive blocks, attached to the hand by adhesive bands, can attach the drive rod to the patients hand whether the fingers are large small, fat or skinny, and maintain the contact without undue discomfort to the wearer for up to 8 to 10 hours a day and without circumferential tension, while effectively driving the finger joints through the desired range of motion.

FIG. 2 shows the connection of the drive rod to the distal gear 54, and to the distal phalanx of the fingers to provide IP joint motion. If MP joint motion is desired, then the ends of the drive rods 50 are attached to the intermediate gears 56 in the gear train. The distal ends of the drive arms which carry the drive rod then rest near to the proximal phalanx of the finger, and attachment is made between the drive rod and the proximal phalanx using the same blocks with adhesive bandage 70 shown in FIG. 7.

Thus the same CPM device is adaptable to a range of hand sized, and can provide either isolated MP joint or IP joint motion.

Once the proper connections are made to the patients hand, then the proper or necessary parameters of the CPM treatment can be stored in the store 80 associated with MPU 82. This MPU which controls the stepper motor in accordance with known and well developed technology, allows programming e.g. in the following modes: Upper limit or extension of the fingers; lower limit or flexion of the fingers; time of running; elapsed time; rate of speed; and amount of force at the finger driving rod. All of this data is input through a keyboard 83 which appears on the front of the power pack 20 which also includes the rechargeable power unit 22.

In view of the fact that a CPM device is disclosed herein is constantly with the patient and not always in the presence of the therapist, an interlock has been provided to prevent patient access to the programmed modes of treatment, the interlock comprises a hole 92 in the housing 10 of the device, cooperating wiht a Hall effect switch 94 adjacent the slot. A program interlock key 96 and comprises a plastic insert with a magnet 97 on the end thereof. By inserting the key 96 in the hole 92 in the housing, a change in state of the Hall effect switch 94 can be detected by the microprocessor which then allows access of the keyboard 83 to change the values in store 80.

Figure 6:
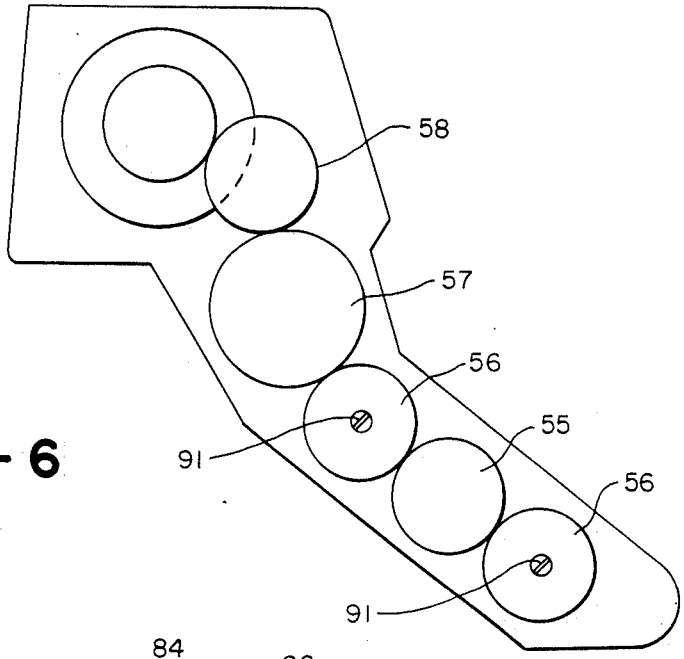
FIG. 6 is a sectional view of the CPM device shown in FIG. 1 showing the gear train which is used to drive the drive arm to provide rotational motion to the joints.
Figure 3:
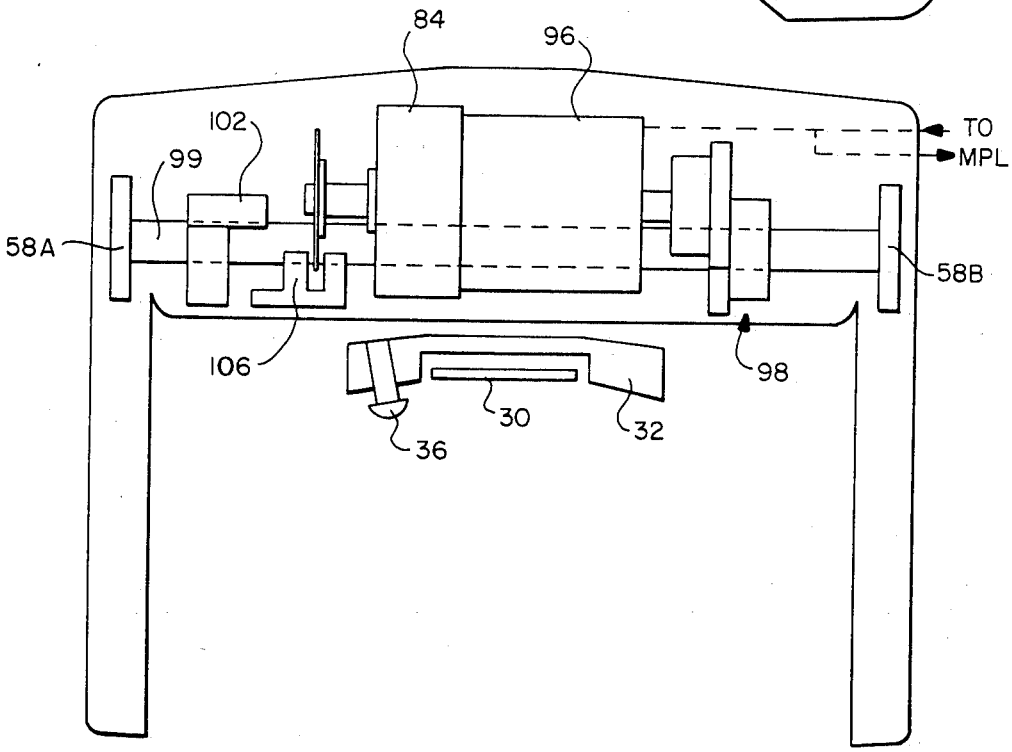
FIG. 3 is a cross sectional view of the device mounted on the hand of the wearer along the line AA of FIG. 2 showing the motor and its connections to the gear train of the arms of the device, as well as the key interlock device and the means for attaching the CPM device to a splint.
Figure 4:
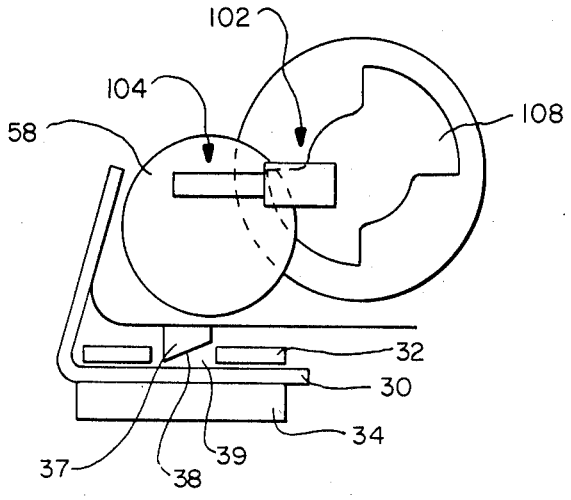
FIG. 4 is a sectional view along the line BB of FIG. 3 showing details of the means for locking the device onto a splint worn on the forearm of the user, as well as the means for encoding the motor position and a zero position actuator.
Figure 5:
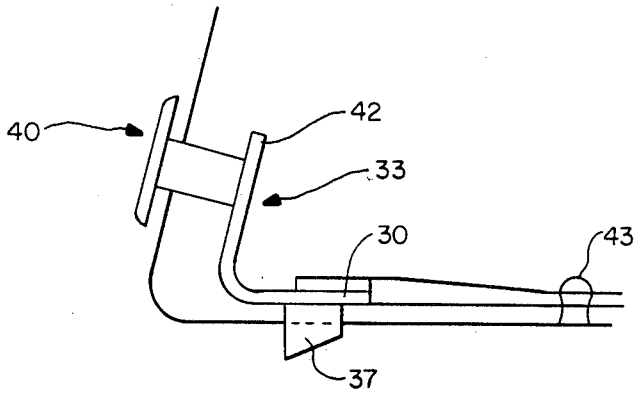

The essential mechanical elements of the system appear in the sectionals view of FIGS. 3, 4 and 6. The drive train consists of a succession of gears 54, 55, 56, 57, 58. This succession of gears allows the arms 90 of the CPM device to be curved to comfortably fit the hand of the user. Further, two different gears 54 and 56 can be provided to which the drive arms can be attached by a screw and bushing arrangement 92 which causes the drive arm 50 to rotate coaxially with the driving gear. Motive of power for driving the gear is provided as explained above by a motor 84 through a gear box 96, gears 98 and a drive shaft 99 which is press fitted into the uppermost gear 58 in each arm, as shown in FIG. 3.

It is, of course important for the microprocessor to always relate its commands for direction and distance of travel to the actual position of the drive arm. Therefore, a microswitch 102 shown in FIG. 2 and FIG. 4 is provided. An adjustable plunger 104 carried on a support block 59 attached to axle 99 rotates into contact with the actuator of the microswitch 102, which in turn sends a signal to the microprocessor 82 indicating that the gear train is in its predetermined zero position.

Rotation of the motor is further checked using a photosensor 106 and strobe disc 108. The strobe disc is cut to provide four segments comprising in succession a ninety degree opening, ninety degree solid ninety degree opening and ninety degree solid. As the disc rotates through channel 109, thus the light from the photosensor is alternately blocked and allowed to pass, so that the microprocessor can track the total rotation provided by the stepper motor 84. The motor 84 is of standard design, its rotation being divided into six degree steps thereby providing 60 steps in a single rotation of the wheel.

In summary, the present invention provide a portable CPM device which may be carried on the hand and forearm of the user. The gear train provides the user the choice of IP joint motion or MP joint motion, depending on the axis of the rotation of the drive arms, and the point of connection of the drive rod carried by the drive arms to the a phalanx of the fingers.

Modifications of the present invention may become apparent to one of skill in the art who has studied the subject invention disclosure. Therefore the subject invention is to be limited only by the scope of the appended claims.

What is claimed is:

1. A device for providing continuous passive motion therapy to one or more fingers of a patient's hand including drive means carried on the patient's hand or arm including drive gear means extending at least partially down the side of the patient's hand and drive arm means coupled to said drive gear means and to at least one finger of the patient's hand for causing flexion and extension of the finger joint with rotation of said drive gears.

2. A device as defined in claim 1 wherein said drive arm means comprise a pair of drive arms connected by a finger drive rod, the drive rod being connected to the said fingers and moving the joints of said fingers in response to movement of said drive arm.

3. A device as claimed in claim 2 wherein said connecting means including means for connecting said drive means individually to each of the fingers of the hand on said patient.

4. A device as claimed in claim 3 wherein said connecting means includes a block having a slot cooperating with said drive rod and means for attaching said block to each said finger on the patient's hand.

5. A device as claimed in claim 4 wherein said block includes a slot extending longitudinally in said block and adapted to be mounted on said drive rod to allow phalangeal joint movement in said fingers while restraining rotation of the fingers about the longitudinal axis of the finger.

6. A device as claimed in claim 5 wherein said attaching means comprises an adhesive strip adapted to be wrapped around the phalanx of the finger.

7. A device as claimed in claim 1 wherein said gear means include at least two coaxial pairs of gears adapted to be located adjacent the fingers of the patient's hand, one end of each of said drive arms being coupled to said gear means said device including a finger drive rod being connected to the distal end of said drive arms and to said fingers to cause the joints of said fingers to move through a known range of motion.

8. A device as claimed in claim 7 wherein said drive arms are connected between a first pair of gears and the distal phalanx of said fingers to cause interphalangeal joint motion in said fingers by movement of said drive arms.

9. A device as claimed in claim 7 wherein said drive arms are connected between a pair of gears included in said gear means and the proximal phalanx in said hand to define metacarpophalangeal joint motion in the fingers in said hand.

10. A device as claimed in claim 1 including a housing for mounting said drive gear means having a pair of support arms adapted to extend parallel to a patient's hand, said drive means having a gear train extending down each support arm, one end of each said gear train being driven by a motor through a common shaft, said finger moving means being connectable to said gears to move said fingers with rotation of said gears to move the joints of said fingers through a range of motion.

11. A device of as claimed in claim 10 including means for connecting said drive arms to said gears in a first position to provide metacarpophalangeal joint motion in said hand, and means for connecting said drive arms to said gears in a second position to provide interphalangeal joint motion in said hand.

12. A device as claimed in claim 11 including means for defining a zero position of said drive arms relative to said motor comprising a microswitch mounted on said housing and an actuator rotatable with said gears to strike said microswitch, thereby defining a limit to the range of motion of said hand.

13. A device as claimed in claim 1 including a housing for mounting said drive means, a tongue mounted on the underside of said housing and adapted to cooperate with a cast-mounted bracket on the back of the patient's hand, the tongue being directed away from the drive means and to the rear of said housing.

14. A device as claimed in claim 13 further comprising locking means positioned on the underside of said housing and cooperating with said bracket to hold the housing in place on the patient's hand.

15. A device as claimed in claim 14 wherein said locking means further comprises a polygon shaped lock catch element on the underside of said housing, the bottom surface of said polygon being upwardly inclined away from the drive means on said housing, said polygon locking element being adapted to slide over the surface of said bracket, and to cooperate with a slot in said bracket to hold said housing in place.

16. A device as claimed in claim 15 wherein said polygon is fastened to a base portion of a L-shaped carrier, said locking means including a handle located in the portion of said housing facing said drive means, the base of said handle resting the upright portion of said carrier, said carrier pivoting about the distal portion of said base whereby depression of said handle raises said polygon out of the cooperating slot in said bracket.

17. A device as claimed in claim 1 further comprising control means for said drive means, said control means comprising a motor, a keyboard, a microprocessor for reading inputs from said keyboard, storing said inputs, and controlling said motor in response to said inputs.

18. A device as claimed in claim 17 further comprising access interlock means connected to said microprocessor for limiting access through said keyboard to said microprocessor store.

19. A device as claimed in claim 18 wherein said access interlock means comprises a Hall effect switch mounted on the top of said housing, said housing having a recess adjacent said switch adapted to receive a magnetic carrying key, the state of said switch indicating to said microprocessor the presence or absence of said key.

20. A device as claimed in claim 1 wherein said connecting means including means for connecting said drive means individually to each of the fingers of the hand on said patient.

21. A device for selectively attaching the fingers of a patient's hand to the drive arm of a continuous passive motion therapy device adapted to convey rotation movement to the finger joints through a drive rod extending perpendicualar to the patient's fingers, the attaching device comprising a drive block having a slot for receiving the drive rod and means for selectively attaching the block to the patient's hand.

22. A device as claimed in claim 21 wherein said block includes a slot extending longitudinally in said block and adapted to be mounted on said drive rod to allow phalangeal joint movement in said fingers while restraining rotation of the fingers about the longitudinal axis of the finger.

23. A device as claimed in claim 22 wherein said attaching means comprises an adhesive strip adapted to be wrapped around the phalanx of the finger.

* * * * *